US007793373B2

(12) United States Patent
Feinberg

(10) Patent No.: US 7,793,373 B2
(45) Date of Patent: Sep. 14, 2010

(54) METHOD OF REPETITIVELY CONDITIONING CLEANING CLOTHS WITH CLEANING SOLUTION

(76) Inventor: Ira A. Feinberg, 2 Horizon Rd., Suite 269, Fort Lee, NJ (US) 07024

( * ) Notice: Subject to any disclaimer, the term of this patent is extended or adjusted under 35 U.S.C. 154(b) by 1051 days.

(21) Appl. No.: 11/440,685

(22) Filed: May 24, 2006

(65) Prior Publication Data

US 2007/0271708 A1 Nov. 29, 2007

(51) Int. Cl.
*D06F 39/04* (2006.01)

(52) U.S. Cl. ..... 8/158

(58) Field of Classification Search ..... 8/158
See application file for complete search history.

(56) References Cited

U.S. PATENT DOCUMENTS

| | | | | |
|---|---|---|---|---|
| 3,500,611 | A | 3/1970 | Field | |
| 3,688,465 | A | 9/1972 | Benitez et al. | |
| 4,117,187 | A | 9/1978 | Adams et al. | |
| 4,749,080 | A * | 6/1988 | Toohey | 206/210 |
| 5,058,738 | A | 10/1991 | Svensson | |
| 5,560,016 | A | 9/1996 | Fiebrich et al. | |
| 5,593,508 | A | 1/1997 | Gatt et al. | |
| 6,009,585 | A * | 1/2000 | Middleton | 8/158 |
| 6,131,731 | A | 10/2000 | Wooley | |
| 6,170,426 | B1 | 1/2001 | Thorsbakken | |
| 6,172,031 | B1 * | 1/2001 | Stevens | 510/417 |
| 6,749,148 | B2 | 6/2004 | Helfer-Grand | |
| 6,802,908 | B2 | 10/2004 | Zachhuber | |
| 2003/0157856 | A1 | 8/2003 | Schroeder et al. | |
| 2004/0118431 | A1 | 6/2004 | Flynn | |
| 2005/0087317 | A1 | 4/2005 | Rydell | |
| 2005/0092352 | A1 | 5/2005 | Luckman | |
| 2005/0159063 | A1 | 7/2005 | Hill et al. | |

* cited by examiner

*Primary Examiner*—Michael Barr
*Assistant Examiner*—Jason P Riggleman
(74) *Attorney, Agent, or Firm*—Ware, Fressola, Van Der Sluys & Adolphson, LLP

(57) ABSTRACT

Window cleaning cloths are repetitively conditioned for cleaning windows in a commercial car wash by processing the cloths in a washer-extractor having in sequence a wash cycle, a first rinse and spin cycle and a final rinse and spin cycle. A detergent and degreaser are added to the water used in the wash cycle. A window cleaning solution is added to the rinse water used in the final rinse and spin cycle to saturate the cloths with a diluted mixture of water and window cleaning solution. A substantial portion of the diluted mixture of final rinse water and window cleaning solution is removed during the final rinse and spin cycle to provide a window cleaning cloth uniformly dampened with window cleaning solution for cleaning windows without necessity of spray application of cleaning solution. The cloths are reprocessed and used in the same manner.

10 Claims, 2 Drawing Sheets

METHOD OF REPETITIVELY CONDITIONING CLEANING CLOTHS WITH CLEANING SOLUTION

FIELD OF INVENTION

The invention herein relates to providing a renewable supply of cleaning cloths uniformly dampened with cleaning solution, and especially to repetitively conditioning window cleaning cloths for use in a commercial car wash.

BACKGROUND OF INVENTION

A commercial car wash requires a large number of window cleaning cloths on a continuing basis. Cleaning cloths used in cleaning windows must be refreshed in accordance with the volume of cars washed. Customers often judge the quality of a car wash by the cleanliness of the windows, as it is one of the most apparent aspects of the car wash.

According to presently used methods, cleaning windows in car washes is accomplished with a spray bottle containing window cleaning solution and a supply of window wiping cloths, terry cloth towels or other towels. These will all be referred to as window wiping cloths. The window cleaning solution is sprayed on the window, and the window is thereafter wiped with a window wiping cloth. Alternatively, the window cleaning solution is sprayed onto a window wiping cloth and the cloth is then used to wipe the window. Sometimes a drying cloth is used to complete the window cleaning process.

These methods of cleaning windows have major disadvantages that the car wash industry has put up with during its entire history. First, windows are often not well cleaned, in large part because the presently used methods tend to leave streaks, smears and smudges on the windows. When the window cleaning solution is sprayed on the window, the distribution of the spray is generally unevenly distributed and the window is rarely completely and uniformly covered with spray. When the cloth is then wiped over the window and window cleaning solution, the cloth absorbs the window cleaning solution but also does so unevenly, such that some areas of the window are thoroughly cleaned and wiped with an adequate amount of window cleaning solution but other areas of the windows are not. Often, the spray application will leave a film on the windows which can sometimes be seen after the windows have been cleaned, especially in sunshine. Also, lines and markings can sometimes be seen where the wiping cloth has been used. The result is that some areas of the windows are not well cleaned, instead having a streaked or smudged appearance. Spraying the window cleaning solution onto the windows also results in some spray settling onto the dashboard or other trim areas of the car adjacent the windows. These areas must then be wiped with the cloth, and may exhibit streaks and smudges in the same way as an incompletely cleaned window.

The situation is not improved by spraying the window cleaning solution directly onto the window wiping cloth before wiping the windows. In this technique, only a few pulses of spray are applied to the window wiping cloth wherein the window wiping cloth does not acquire an even distribution of window cleaning solution. It follows that some areas of the window are not adequately cleaned when wiped with the window wiping cloth and the window cleaning solution, also resulting in a partially cleaned window with streaks and smudges.

In both of the aforesaid methods, the lack of even distribution of the window cleaning solution sometimes leaves areas of the windows with an excess of window cleaning solution that must be removed by subsequent buffing with a dry cloth or towel, increasing the time, effort and labor to clean the windows. This does not necessarily improve the cleaning.

Another major disadvantage of the present methods of cleaning windows in car washes is inefficient use of labor. The window cleaner must carry a minimum of a spray bottle and one cloth, and sometimes must carry two cloths. The window cleaner must then exert time and effort to operate the spray bottle in order to spray window cleaning solution across the expanse of windows to be cleaned, or to spray the window cleaning solution onto the window wiping cloth. The window cleaner must then must perform a second step of wiping the windows after the window cleaning solution has been applied. Often, a third step of wiping with a dry towel is required to remove any excess window cleaning solution on the windows or dashboard. Finally, the labor aspect of the present window cleaning process is exacerbated by a conscientious worker's effort to produce clean windows by spending extra time and effort in the wiping portion of the process.

When the cloths used in window cleaning become dirty, they are washed in a commercial washer-extractor, which is a very heavy duty washing machine with high speed, high G-force extraction capability, generally found on the premises at commercial car washes. These machines have a strong spin capability to remove substantial amounts of rinse water. Gas or electric dryers are also available for drying cleaning cloths and towels; however, the dryers take additional time and use additional energy.

Clearly an improved way of cleaning windows in car washes or other high volume cleaning situations would be a welcome advance in the art.

SUMMARY OF THE INVENTION

It is a principal object of the invention herein to increase the effectiveness and efficiency of cleaning windows and other similar surfaces.

It is another object of the invention herein to repetitively condition a supply of window cleaning cloths.

It is a further object of the invention herein to repetitively condition a supply of window cleaning cloths for use at a commercial car wash.

In carrying out the invention herein, a renewable supply of window cleaning cloths is provided by repetitively conditioning the cloths in a washing machine, and preferably a commercial washer-extractor, of the type having in sequence a wash cycle using wash water, a first rinse and spin cycle using first rinse water and a final rinse and spin cycle using final rinse water. A washing agent is added to the wash water used in the wash cycle. A degreaser is also preferably added to the wash water. A window cleaning solution is added to the final rinse water used in the final rinse and spin cycle, thereby saturating the window cleaning cloths with a diluted mixture of water and window cleaning solution. A substantial portion of the diluted mixture of water and window cleaning solution is removed by the spin portion of the final rinse and spin cycle to provide window cleaning cloths substantially uniformly dampened with window cleaning solution. The process is repeated to repetitively condition the cloths for window cleaning, and thereby provide a supply of window cleaning cloths.

The amount of window cleaning solution added to the final rinse water is selected such that the uniformly dampened window cleaning cloths clean windows with a moderate amount of wiping, and any portion of the diluted window cleaning solution evaporates quickly without further wiping. The windows are well cleaned, without streaks, smears or smudges.

According to an aspect of the invention, the window cleaning cloths are placed in a container after conditioning and before used, and the container may be covered to prevent loss of window cleaning solution by evaporation.

In accordance with further aspects of the invention, the window cleaning solution is added to the final rinse water in a metered amount. The window cleaning solution may be added by an automated dispensing station programmed to deliver the desired amount.

According to additional objects of the invention, the dampness of the conditioned window cleaning cloths is optimized by adjusting the spin time of the final rinse and spin cycle, adjusting the spin speed of the final rinse and spin cycle, or by adjusting a combination of the spin time and spin speed of the final rinse and spin cycle. These amounts may be programmed.

In another aspect of the invention, the wash cycle cleaning agent and the window cleaning solution are selected for compatibility, and a compatible degreaser may be added to the wash water.

Other more and specific objects and features of the invention herein will appear in the following detailed description taken together with the drawings.

BRIEF DESCRIPTION OF DRAWINGS

The same reference numerals refer to the same elements throughout the various figures.

DESCRIPTION OF INVENTION

The invention herein relates to a method of repetitively conditioning a supply of window cleaning cloths, especially for window cleaning in commercial car washes. The window cleaning cloths may also be towels, and the term "cloths" is intended to encompass all fabrics suitable for wiping windows and being washed. Similarly, the term "car" is meant to encompass all vehicles washed at commercial car washes.

In a commercial car wash, cars are moved along conveyor through a wash line of equipment that washes, rinses and blow dries the car. At the end of the car wash line, workers finish the car by wiping the exterior of the car with towels to complete the drying process. The exterior drying towels get wet and dirty and must be periodically washed and at least partially dried. A supply of towels is cycled through laundry equipment maintained and operated at the car wash facility. A dryer is also maintained and operated for further drying of towels after they are washed, as required.

The car is also finished by cleaning the interior of the windows with window cleaning cloths. As described above, the window wiping cloths have been used with a spray bottle of window cleaning solution. The window cleaning solution may either be sprayed on the windows and then wiped with a cloth, or maybe sprayed onto the cloth and the cloth used to wipe the windows. A second cloth is generally used to complete and dry the window. The window cleaning cloths also become dirty, and are washed and dried in the laundry equipment. In the prior art operation of car washes, the window cleaning cloths and the drying towels are often used interchangeably, in that both of them are processed in the laundry equipment to a dry or substantially dry condition.

Figure 2:
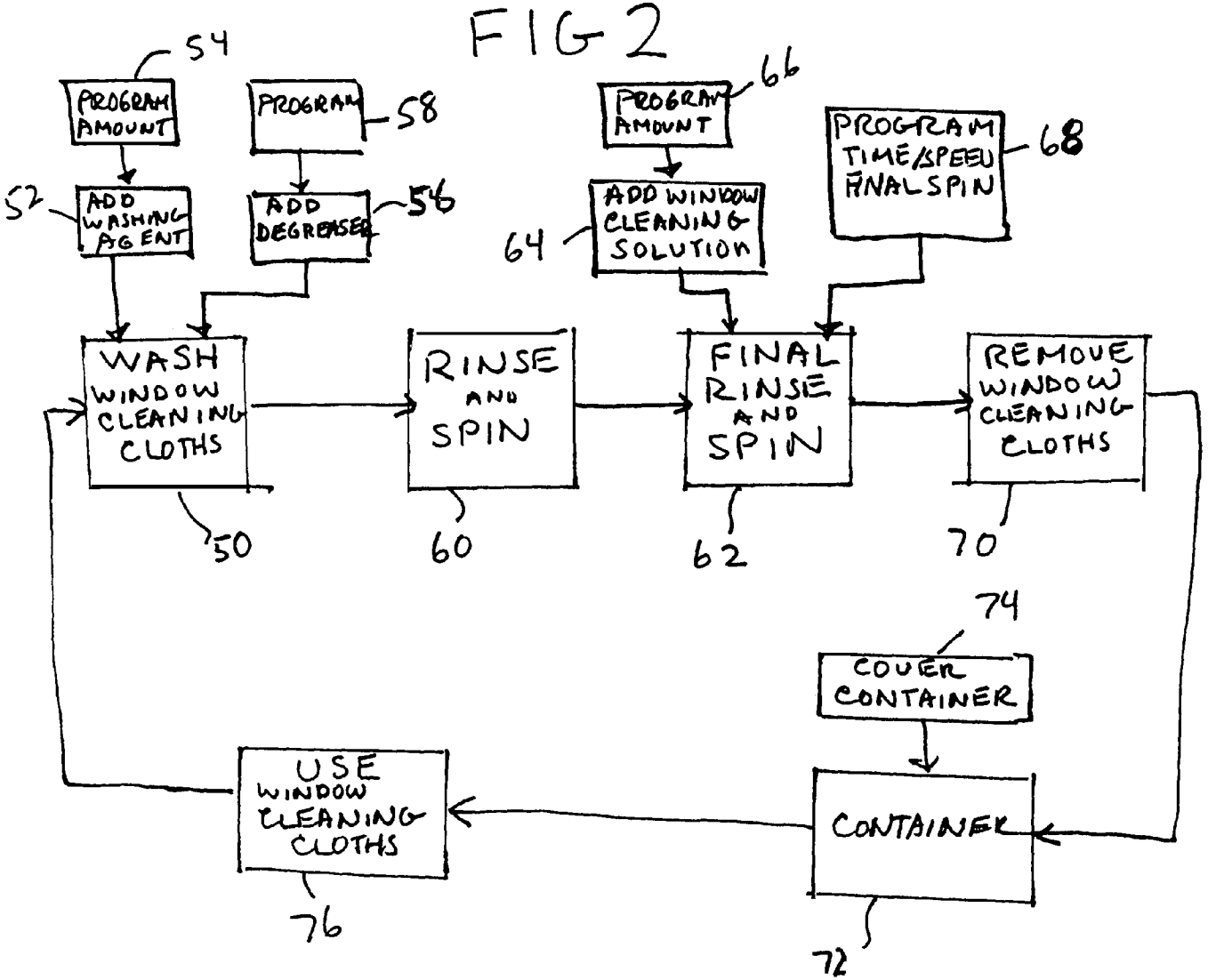
FIG. 2 is a flow chart illustrating the invention herein.

Referring to FIG. 2, laundry equipment of the type generally found at a commercial car wash is illustrated, adapted as required to carry out the invention herein. The laundry equipment first includes a washer-extractor 10 having a microprocessor 12 associated therewith for controlling its operation. The microprocessor 12 has a key pad 14 for programming purposes. The washer-extractor 10 is essentially a very heavy duty front loading commercial washing machine, having a door 16 opening into a tub 18. As used herein, the term "washer-extractor" is meant to include washing machines having corresponding was and rinse/spin cycles. The washer-extractor 10 typically performs a wash cycle, a first rinse and spin cycle and a final rinse and spin cycle. The microprocessor 12 can be programmed to control parameters of these cycles, such as agitator rotation options, the temperature of the water for the wash/rinse cycles, water levels, and the times of the various cycles. The spin cycles are also programmable for G-force attained by varying the spin speeds as well as the time of the spin cycle.

The washer-extractor 10 has a signal strip 20 for connections to automatic chemical dispensers and at least three inlet ports 22, 24 and 26 for receiving dispensed liquids, which are added to the water by the washer-extractor 10. Although the signal strip 20 and inlet ports 22, 24 and 26 shown on the side of the washer-extractor 10 in FIG. 1, they are typically placed on the back of the machine. The signal strip 20 may typically provide up to five independent signals corresponding to parameters of the operation of the washer-extractor 10, such as what cycle is being performed, when water is being introduced to the tub 18, etc.

Examples of suitable washer-extractors for carrying out the invention herein are the Continental-Girbau models distributed by Girbau, Inc. of Osh Kosh, Wis. The Continental-Girbau washer-extractors are made in 18 pound, 20 pound, 30 pound and 55 pound capacities, under current model nos. HP2018PM, H2020PM, H2030PM and H2055PM respectively, as well as other higher capacities. The size of a washer-extractor used at a particular commercial car wash is selected based on the number of cars washed and serviced each day.

The laundry equipment further includes a dispenser station 30, which operates in cooperation with the washer-extractor 10 to add liquid cleaning products to the water in the tub 18. The dispenser station 30 is programmable by means of key pad 32 to dispense the correct amount of product, and communicates with the washer-extractor 10 through the sensor strip 20 so that the product is supplied at the proper time and cycle. Communication is established between the signal strip 20 and the dispenser station 30 by a cable 28, and product is supplied through one or more of conduits 34, 36, 38 to washer inlet ports 22, 24, 26.

The dispenser station 30 pumps the supplied products from reservoirs 40, 42 and 44 via conduits 41, 43 and 45. The liquid cleaning product 40 is a washing agent, such as a detergent or other cleaning agent, and in carrying out the invention herein is preferably SuperPlus towel detergent sold by Panaram International Trading Company, Inc. of Belleville, N.J. The second product reservoir 42 preferably contains Super Degreaser, also sold by Panaram International Trading Company, Inc. The SuperPlus detergent is formulated to wash and clean dirt from car wash towels and cloths, and Super Degreaser is formulated to remove grease from towels and cloths that have removed waxy or oily residue from cars. The SuperPlus detergent and Super Degreaser are compatible in their chemical formulation. These two products are added to the wash water used in the wash cycle of the washer-extractor 10, and may be used when washing towels or when washing window cleaning cloths. The third product reservoir 44 contains a window cleaning solution that is added to the final rinse water during the final rinse and spin cycle. The window cleaning solution is preferably Hot Glass® perfect window cleaner, also sold by Panaram International Trading Company, Inc. It is also chemically compatible with the Super Plus detergent and Super Degreaser.

A dispenser station 30 is suitable for carrying out the invention is Dema 831 Laundry Master, manufactured and sold by Dema Engineering Company of St. Louis, Mo. The Dema Laundry Master Dispensing Station may be purchased with one single head pump and one double head pump and may be adapted to three outlets, so that it will readily accommodate the three product reservoirs 40, 42 and 44.

It is, of course, preferable to use high quality window cleaning cloths that may be washed repeatedly without fraying or developing lint, and that exhibit good wiping action. The preferred towels are Micro Fiber "Magic" Waffle Weave Window Towels Product No. 1621F1OBS sold by Panaram International Trading Company, Inc., and its Blue Surgical Window Towel Product No. 1627IF25G4 are also suitable.

Figure 1:
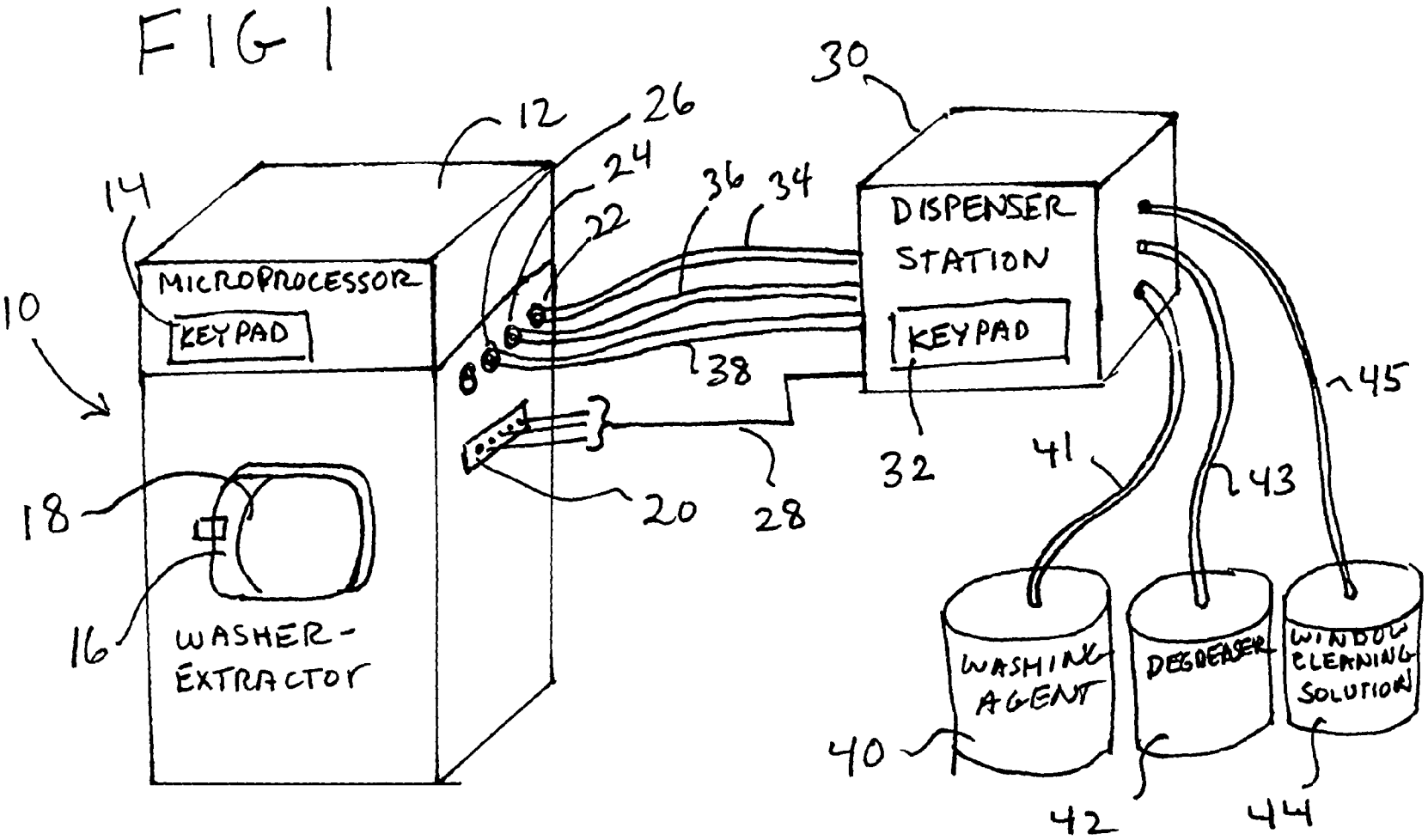
FIG. 1 illustrates a laundry station for carrying out the invention herein.

With reference to FIG. 2 and with continued reference to FIG. 1, the method of providing a renewable supply of window cleaning cloths by repetitively conditioning the cloths is illustrated. The window cleaning cloths are first washed, as indicated at 50 in the wash cycle of the washer-extractor 10. A washing agent is added to the wash water as indicated at 52, and the washing agent may be the SuperPlus towel detergent. For a 20-pound capacity washer-extractor, approximately 2 fluid ounces of the SuperPlus towel detergent may be used. A degreaser such as Super Degreaser may also be added to the water, as indicated 56 and 2 fluid ounces of Super Degreaser is preferable. For a 30-pound capacity washer-extractor 10, 4 fluid ounces of SuperPlus towel detergent and 4 fluid ounces of Super Degreaser are added to the wash water. For a 55 pound capacity washer-extractor, 5 fluid ounces of SuperPlus towel detergent and 5 fluid ounces of Super Degreaser are utilized. It will be appreciated that the degreaser is useful but optional in that the window cleaning cloths are not exposed to wax and oily residues to the same extent as the drying towels used on the exterior of cars, but it has been found that utilizing a degreaser in addition to a towel detergent ensures a very clean window cleaning cloth. Using degreaser is particularly advantageous when the car wash cleans both the inside and outside of the windows with the window cleaning cloths, as the outside of the windows may have an oily or waxy residue. The amounts of cleaning agent and degreaser to be added are programmed, as indicated at 54 and 58, and these amounts as well as the duration of the wash cycle may be modified depending on the particular circumstances and conditions.

After washing, the washer-extractor 10 is operated in a first rinse and spin cycle, as indicated at 60 in FIG. 2 to substantially remove the washing agent and degreaser, together with the loosened dirt, wax and oily residue.

The washer-extractor 10 is then operated in a final rinse and spin cycle as indicated at 62. Window cleaning solution is added to the final rinse water, as indicated at 64 of FIG. 2, in a programmed amount as indicated at 66 of FIG. 2. The amount of Hot Glass window cleaning solution preferably programmed for a 20-pound capacity washer-extractor is 2 fluid ounces, and 4 fluid ounces are used for a 30-pound capacity washer-extractor. A 55-pound capacity washer-extractor is preferably provided with 5 fluid ounces of Hot Glass window cleaning solution in the final rinse water.

During the rinse portion of the final rinse and spin cycle, the window cleaning solution is diluted in the rinse water and is substantially evenly distributed throughout the window cleaning cloths. In the spin portion of the final rinse and spin cycle, a substantial amount but not all of the diluted mixture of water and window cleaning solution is removed from the window cleaning cloths, leaving them in a damp condition. The desired degree of dampness is determined primarily empirically, such that when wiping windows with the damp window cleaning cloths, a thin, non-beaded film of liquid appears on the area of the window most recently wiped, the film being of a thickness that it evaporates within a few seconds. The conditioned window cleaning cloths must be sufficiently damp to have solvent action, but not too damp so as to have beads of moisture. The degree of dampness of the conditioned window cleaning cloths is best determined empirically because of the many factors involved, such as the type of window cleaning cloth and the temperature and humidity at the time of use. The washer-extractor 10 has a provision for programming the spin cycle, including adjusting the speed of the spin which establishes the centrifugal force applied to the window cleaning cloths and the mixture of water and window cleaning solution therein, and adjusting the duration of the spin. These programming options are indicated at 68 of FIG. 2. In a typical situation, a Continental-Girbau washer-extractor might be programmed for a final rinse and spin cycle of 4-5 minutes at a speed providing 300-380 Gs in centrifugal force, depending on the size of the washer-extractor, in a typical cycle, with adjustments made to optimize the degree of dampness of the conditioned window cleaning cloths.

Thereafter, the window cleaning cloths are removed from the washer-extractor as indicated at 70 and are placed in a container, as indicated at 72, from which they may be removed for use in cleaning windows. If the window cleaning cloths are not needed promptly after they are removed from the washer-extractor, it is necessary to store them in a covered container, as indicated at 74 so that the window cleaning solution does not evaporate from the towels before use, indicated at 76. If the window cleaning cloths dry out, such as overnight, they may be run through a rinse cycle with window cleaning solution in the rinse water to prepare them for use.

For best window cleaning results, a window cleaning cloth should be used to clean the windows of one car, and then should be conditioned as described above before the next use. The window cleaning cloths will build up dirt and film residues if used more than once, and the window cleaning solution will evaporate from the cloth before several uses can occur.

The window cleaning cloths that are prepared in the foregoing manner permit the worker to clean windows utilizing one window cleaning cloth, and to avoid the use of spray bottles. Because the window cleaning cloths are uniformly saturated with the mixture of water and window cleaning solution, the window cleaning solution is evenly applied to windows, i.e. any area wiped is uniformly cleaned. If desired, the windows may be buffed with a dry cloth and a dry cloth may also be employed if the dampness of the window cleaning cloths is not adjusted properly; however, this is not typically necessary and in any event the use of spray bottles is avoided, except as an assist for very soiled windows, such as windows with heavy smoke film. After the window cleaning cloths have been used, they are collected and re-deposited in the washer-extractor 10 in preparation for their next use.

It has been found that utilizing the foregoing method of providing a renewable supply of window cleaning cloths by repetitively conditioning the cloths with window cleaning solution results in clean, streak and smudge free windows. That increases the satisfaction of the customers of the car wash facility. Additionally, the use of the conditioned window cleaning cloths has been found to reduce labor, time and complexity, which results in increased worker satisfaction and increased profits.

Although the invention has been described in the context of cleaning windows of cars, the term "cars" is meant to embrace all vehicles with windows and the term "windows" is meant to embrace other hard surfaces or other glass items generally cleaned by wiping.

It will be appreciated that the foregoing description represents a preferred embodiment of the invention and that various modifications may be made. The invention may be carried out in other washer-extractors or washing machines and other equipment or methods of introducing the cleaning agents and window cleaning solution may be used. Similarly, other cleaning agents, degreasers and window cleaning solutions may be used, and other changes may be made. Therefore, the invention described herein is believed to admirably achieve the objects of the invention and its scope is limited only by the following claims.

What is claimed is:

1. A method of providing a renewable supply of window cleaning cloths comprising repetitively conditioning the window cleaning cloths for window cleaning by:

A) processing the window cleaning cloths in a washer-extractor of the type having in sequence a wash cycle using wash water, a first rinse and spin cycle using first rinse water and a final rinse and spin cycle using final rinse water, B) adding a washing agent to wash water used in the wash cycle, C) adding a window cleaning solution to the final rinse water used in the final rinse and spin cycle to saturate the window cleaning cloths with a diluted mixture of water and window cleaning solution, D) removing a substantial portion of the diluted mixture of final rinse water and window cleaning solution from the window cleaning cloths during the spin portion of the final rinse and spin cycle, while retaining a sufficient portion of the diluted mixture of final rinse water and window cleaning solution in the window cleaning cloths to condition the window cleaning cloths for cleaning windows by wiping without application of additional window cleaning solution to the window cleaning cloths or the windows, E) maintaining the window cleaning cloths dampened with retained diluted mixture of final rinse water and window cleaning solution prior to using the conditioned window cleaning cloths for cleaning windows, and F) cleaning windows by wiping the windows with conditioned window washing cloths without the application of additional window cleaning solution to the window cleaning clothes or windows, and G) repeating the conditioning of the window cleaning cloths after the window cleaning cloths are used for window cleaning.

2. A method of providing a renewable supply of window cleaning cloths as defined in claim 1 wherein the step of repeating the conditioning of the window cleaning cloths is carried out for each window cleaning cloth after it has been used for cleaning the windows of one car.

3. A method of providing a renewable supply of window cleaning cloths as defined in claim 1 and further comprising storing conditioned window cleaning cloths in a closed container prior to use of the window cleaning cloths.

4. A method of providing a renewable supply of window cleaning cloths as defined in claim 1 and further comprising selecting the parameters of the spin portion of the final rinse and spin cycle to remove a substantial portion of the diluted mixture of final rinse water and window cleaning solution from the window cleaning towels while retaining a sufficient portion of the diluted mixture of final rinse water and window cleaning solution to condition the window cleaning cloths for cleaning windows by wiping without application of additional window cleaning solution to the window cleaning cloths or the windows.

5. A method of providing a renewable supply of window cleaning cloths as defined in claim 4 wherein the time of the spin portion of the final rinse and spin cycle is adjusted.

6. A method of providing a renewable supply of window cleaning cloths as defined in claim 4 wherein the speed of the spin portion of the final rinse and spin cycle is adjusted.

7. A method of providing a renewable supply of window cleaning cloths as defined in claim 1 wherein the step of adding a window cleaning solution to the final rinse water is carried out by metering the amount of window cleaning solution added to the final rinse water.

8. A method of providing a renewable supply of window cleaning cloths as defined in claim 1 and further comprising selecting a chemically compatible window cleaning solution and washing agents.

9. A method of providing a renewable supply of window cleaning cloths as defined in claim 8 and further comprising added a degreaser compatible with the washing agent to wash water used in the wash cycle.

10. A method of cleaning vehicle windows in a commercial car wash comprising wiping the windows with window cleaning cloths conditioned by:

A) processing the window cleaning cloths in a washer-extractor of the type having in sequence a wash cycle using wash water, a first rinse and spin cycle using first rinse water and a final rinse and spin cycle using final rinse water, B) adding a washing agent to wash water used in the wash cycle, C) adding a window cleaning solution to the final rinse water used in the final rinse and spin cycle to saturate the window cleaning cloths with a diluted mixture of final rinse water and window cleaning solution, D) removing a substantial portion of the diluted mixture of final rinse water and window cleaning solution from the window cleaning cloths during the spin portion of the final rinse and spin cycle, while retaining a sufficient portion of the diluted mixture of final rinse water and window cleaning solution in the window cleaning cloths to condition the window cleaning cloths for cleaning windows by wiping without application of additional window cleaning solution to the window cleaning cloths or the windows, E) maintaining the window cleaning cloths dampened with retained diluted, mixture of final rinse water and window cleaning solution prior to using the conditioned window cleaning cloths for cleaning windows, F) cleaning windows of vehicles by wiping the windows with conditioned window washing cloths without the application of additional window cleaning solution to the window cleaning cloths or windows, and G) repeating the conditioning of window cleaning cloths after the window cleaning cloths are used for window cleaning.

* * * * *